US008313162B2

(12) United States Patent
Oki et al.

(10) Patent No.: US 8,313,162 B2
(45) Date of Patent: Nov. 20, 2012

(54) RECORDING APPARATUS

(75) Inventors: Narihiro Oki, Matsumoto (JP); Tsunenobu Endo, Matsumoto (JP); Hidetoshi Kodama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 613 days.

(21) Appl. No.: 11/939,349

(22) Filed: Nov. 13, 2007

(65) Prior Publication Data

US 2008/0259116 A1 Oct. 23, 2008

(30) Foreign Application Priority Data

Nov. 14, 2006 (JP) ..... 2006-308261
Sep. 28, 2007 (JP) ..... 2007-253618

(51) Int. Cl.
*B41J 29/38* (2006.01)
*B41J 2/165* (2006.01)

(52) U.S. Cl. ..... 347/14; 347/31

(58) Field of Classification Search ..... 347/31, 347/76, 8, 19, 23, 54–55, 11–14, 5, 47
See application file for complete search history.

(56) References Cited

U.S. PATENT DOCUMENTS 6,076,909 A * 6/2000 Saeki et al. ..... 347/8
7,543,904 B2 * 6/2009 Izuo ..... 347/19
2006/0181576 A1 * 8/2006 Endo et al. ..... 347/55
2006/0187264 A1 * 8/2006 Endo ..... 347/55
2007/0076030 A1 * 4/2007 Izuo ..... 347/9

FOREIGN PATENT DOCUMENTS

JP 11245390 A * 9/1999
JP 2003-341109 12/2003
JP 2004-174749 6/2004
JP 2004-202867 7/2004
JP 2006-224384 8/2006

* cited by examiner

*Primary Examiner* — Jason Uhlenhake
(74) *Attorney, Agent, or Firm* — Maschoff Gilmore & Israelsen

(57) ABSTRACT

There is provided a recording apparatus including a recording head which includes a nozzle plate having conductive property including an opening and for ejecting ink toward a medium to be recorded from the opening, an absorbing member disposed so as to oppose the nozzle plate in the ejecting direction of the ink from the recording head and for absorbing the ink not adhered to the medium to be recorded, an electrode disposed so as to make contact with the absorbing member, and an electric potential difference generator for generating an electric potential difference between the nozzle plate and the electrode and electrically attracting the ink not adhered to the medium to be recorded toward the electrode side. The electric potential difference generator generates an electric potential difference so that the magnitude of the electric potential difference is varied in accordance with a distance between a portion of the absorbing member to which the ink is absorbed and the nozzle plate.

6 Claims, 9 Drawing Sheets

RECORDING APPARATUS

BACKGROUND

1. Technical Field

The present invention relates to a recording apparatus, and in particular to a recording apparatus by which ink ejected from an opening of a nozzle plate attached to a recording head adheres to a medium to be recorded.

2. Related Art

An ink jet type recording apparatus as an example of a recording apparatus ejects ink to an area slightly larger than the dimension of a recording paper in expectation of inevitable displacement of a recording head with respect to the recording paper when ink adheres to a marginal portion of the recording paper as a medium to be recorded without remaining a margin. Consequently, the ink jet type recording apparatus ejects ink also to the area in which the recording paper dose not exist at the vicinity of the both side marginal portions and top and bottom portions of the recording paper. Consequently, an absorbing member is disposed at the opposite side of the recording head with respect to the recording paper to absorb the ink not adhered to the recording paper. Herewith, stain of the surrounding area by the ink not adhered to the recording paper can be prevented.

Incidentally, when ink adheres to a recording paper, the portion to which the ink is adhered may extend and crease. When winkles contact with the absorbing member, the ink already absorbed in the absorbing member stains the recording paper. Consequently, in ink jet type recording apparatuses, a gap about 2 to 4 mm is often provided between the recording paper and the absorbing member in consideration for the height of the winkles of the recording paper. Further, a gap about 1 mm is provided also between the nozzle plate and the recording paper. Accordingly, a gap about 3 to 5 mm is provided between the nozzle plate and the absorbing member.

Further, in order to make the distance between the nozzle plate and the recording paper at a fixed distance even when a recording paper having a different thickness is used, the distance between the nozzle plate and the platen, so called a platen gap is adjusted. In this case, the distance from the nozzle plate to the absorbing member is changed about from 3 to 8 mm.

On the other hand, upon request of resolution improvement of a recording image formed by ink on the recording paper, a recent liquid ejecting apparatus miniaturizes a droplet ejected from an opening of a nozzle plate to the degree of several pl. Since such a minute droplet has extremely small mass, a droplet, which has once been discharged, rapidly loses kinetic energy due to viscosity resistance of an atmosphere. Specifically, the velocity of a droplet less than, e.g., 8 pl reaches generally zero after the droplet flies about 3 mm in the atmosphere. A minute droplet losing kinetic energy takes a balance between falling motion by acceleration of gravity and viscous resistance force of an atmosphere, and thus requires long time up to termination of falling. The ink droplet floats in the air till termination of falling and this phenomenon is called as aerosol.

A part of the aerosol generated in this manner floats outside the ink jet type recording apparatus to adhere to the surrounding area. Further, most of the aerosol adheres to each part in the ink jet type recording apparatus. When the aerosol adheres to a transporting path of the recording paper such as a platen, the recording paper to be next transported is tainted. Further, when the aerosol adheres to an electric circuit, a linear scale, a rotary encoder, an optical sensor, or the like, malfunction of the apparatus may be caused. Moreover, when a user touches a part to which aerosol adheres, a hand of the user is also tainted.

An ink jet type recording apparatus equipped with a function for actively collecting aerosol by electric field is disclosed in JP-A-2004-202867. An absorbing member for adhering and absorbing the ink not adhered to a recording paper is disposed at the position facing a nozzle plate in the disclosed ink jet type recording apparatus. Further, a metal member to be one of electrode is disposed on the surface of the absorbing member and the nozzle plate made of metal having an opening for ejecting ink is used as the other electrode.

When a voltage is applied between the electrode and the nozzle plate, an electric potential difference is generated therebetween. Further, an ink droplet ejected from the nozzle plate is charged to the same polarity as that of the nozzle plate by so called lighting rod effect as soon as ejected from the nozzle plate. Accordingly, a minute ink droplet which can be aerosol also flies toward the electrode having an electric potential whose polarity is opposite to the own electric charge by the acting of the coulomb force generated by the electric field and adheres to the electrode. Further, the ink droplet absorbed in the electrode is absorbed by the absorbing member disposed so as to make contact with the electrode.

In the above restraining method of aerosol, for example, when the absorbing member itself has no conductive property and ink has conductive property, an electric potential difference between a portion in which ink is absorbed by the absorbing member (hereinafter referred to as "ink absorbing portion") and the nozzle plate is approximately the same as the electric potential difference between the electrode and the nozzle plate. Consequently, when ink is absorbed by the absorbing member and the distance between the ink absorbing portion and the nozzle plate comes close, the magnitude of the electric filed becomes large with the distance.

In this manner, when the magnitude of the electric field becomes large as the ink is absorbed by the absorbing member, there may occur breakdown between the ink absorbing portion of the absorbing member and the nozzle plate at length. Further, when the magnitude of the electric field becomes too large, there is a disadvantage in that the ink not adhered to the recording paper is accelerated by the electric field to collide against the ink absorbing portion of the absorbing member and the aerosol flies around to stain the nozzle plate and the like.

Further, when the distance between the nozzle plate and the platen is adjusted in accordance with the thickness of the recording paper, the magnitude of the electric field between the ink absorbing portion and the nozzle plate may be changed to deteriorate the collection efficiency of aerosol.

SUMMARY

An advantage of some aspects of the invention is that it provide a recording apparatus described below.

Application Example 1

According to an aspect of the invention, there is provided a recording apparatus including a recording head which includes a nozzle plate having conductive property including an opening and for ejecting ink toward a medium to be recorded from the opening, an absorbing member disposed so as to oppose the nozzle plate in the ejecting direction of the ink from the recording head and for absorbing the ink not adhered to the medium to be recorded, an electrode disposed so as to make contact with the absorbing member, and an electric potential difference generator for generating an electric potential difference between the nozzle plate and the electrode and electrically attracting the ink not adhered to the medium to be recorded toward the electrode side. The electric potential difference generator generates an electric potential difference so that the magnitude of the electric potential difference is varied in accordance with a distance between a portion of the absorbing member to which the ink is absorbed and the nozzle plate.

According to the application example, the fluctuation of the magnitude of the electric field generated by the electric potential difference generated between the nozzle plate and the electrode can be reduced, so that the magnitude of the electric field generated by the electric potential difference does not become too large when the distance between the nozzle plate and a portion of the absorbing member to which the ink is absorbed becomes short. Accordingly, occurrence of breakdown between the nozzle plate and the absorbing member can be prevented. Further, it can be prevented that the ink droplet not adhered to the recording paper is accelerated by the too large electric field to collide at a portion of the absorbing member in which the ink is absorbed, thereby causing aerosol to fly peripherally to stain the nozzle plate and the like.

Application Example 2

It is preferable that the above recording apparatus further includes an electric field detector for detecting an electric field generated by the generated electric field difference between the nozzle plate and the electrode, and the electric field detector outputs a signal in accordance with the magnitude of the electric field to the electric potential difference generator and the electric potential difference generator generates an electric potential difference having a magnitude varied in accordance with the signal output from the electric field detector between the nozzle plate and the electrode.

According to the application example, the fluctuation of the magnitude of the electric field generated between the nozzle plate and the electrode can be reduced.

Application Example 3

It is preferable that the electric potential difference generator includes a first electric potential difference generating section for generating an electric potential difference between the nozzle plate and the electrode when the ink is not absorbed by the absorbing member, a second electric potential difference generating section for generating an electric potential difference smaller the electric potential difference generated by the first electric potential difference generating section between the nozzle plate and the electrode when the ink is absorbed by the absorbing member and the distance comes close, and a switching section for switching the first electric potential difference generating section and the second electric potential difference generating section by detecting the amount of the ink absorbed by the absorbing member in the above recording apparatus.

According to the application example, it can be prevented that the magnitude of the electric field becomes too large even when the distance between a portion of the absorbing member to which the ink is absorbed and the nozzle plate comes close, for example, when the ink is absorbed by the absorbing member.

Application Example 4

It is preferable that the magnitude of the electric field generated by the electric potential difference is the same when the electric potential difference is generated by the first electric potential difference generating section between the nozzle plate and the electrode and when the electric potential difference is generated by the second electric potential difference generating section between the nozzle plate and the electrode in the above described recording apparatus.

According to the application example, it can be prevented that the magnitude of the electric field becomes too large.

Application Example 5

It is preferable that the above described recording apparatus further includes a surface electrode disposed at the nozzle plate side of the absorbing member and made contact with the absorbing member, and a switching signal generator for outputting a signal which instructs to switch to the second electric potential difference generating section to the switching section when the surface electrode is made contact with a portion of the absorbing member in which the ink is absorbed.

According to the application example, it can be more surely detected that the distance between a portion of the absorbing member to which the ink is absorbed by the absorbing member and the nozzle plate comes the closest when the first electric potential difference generating section and the second electric potential difference generating section is switched.

Application Example 6

It is preferable that a distance between the nozzle plate and a supporting surface of the medium to be recorded can be changed, and the electric potential difference between the nozzle plate and the electrode is different in accordance with the distance between the nozzle plate and the supporting surface of the medium to be recorded in the above described recording apparatus.

In the application example, even when recording paper having a different thickness is used, the distance between the recording surface and the nozzle plate is set to an approximately fixed distance. Accordingly, positional misalignment of the ink on the recording surface can be reduced and stable recording image quality can be obtained, and the above effects can be provided.

Note that the summary of the invention does not necessarily describe all necessary features of the present invention. The present invention may also be a sub-combination of the features described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments will be described. However, the embodiments described below do not restrict the invention according to the claims. Further, it is not necessary that all of the combinations of characteristics illustrated in the embodiments are essential in the means to be solved by the invention.

First Embodiment

Figure 1:
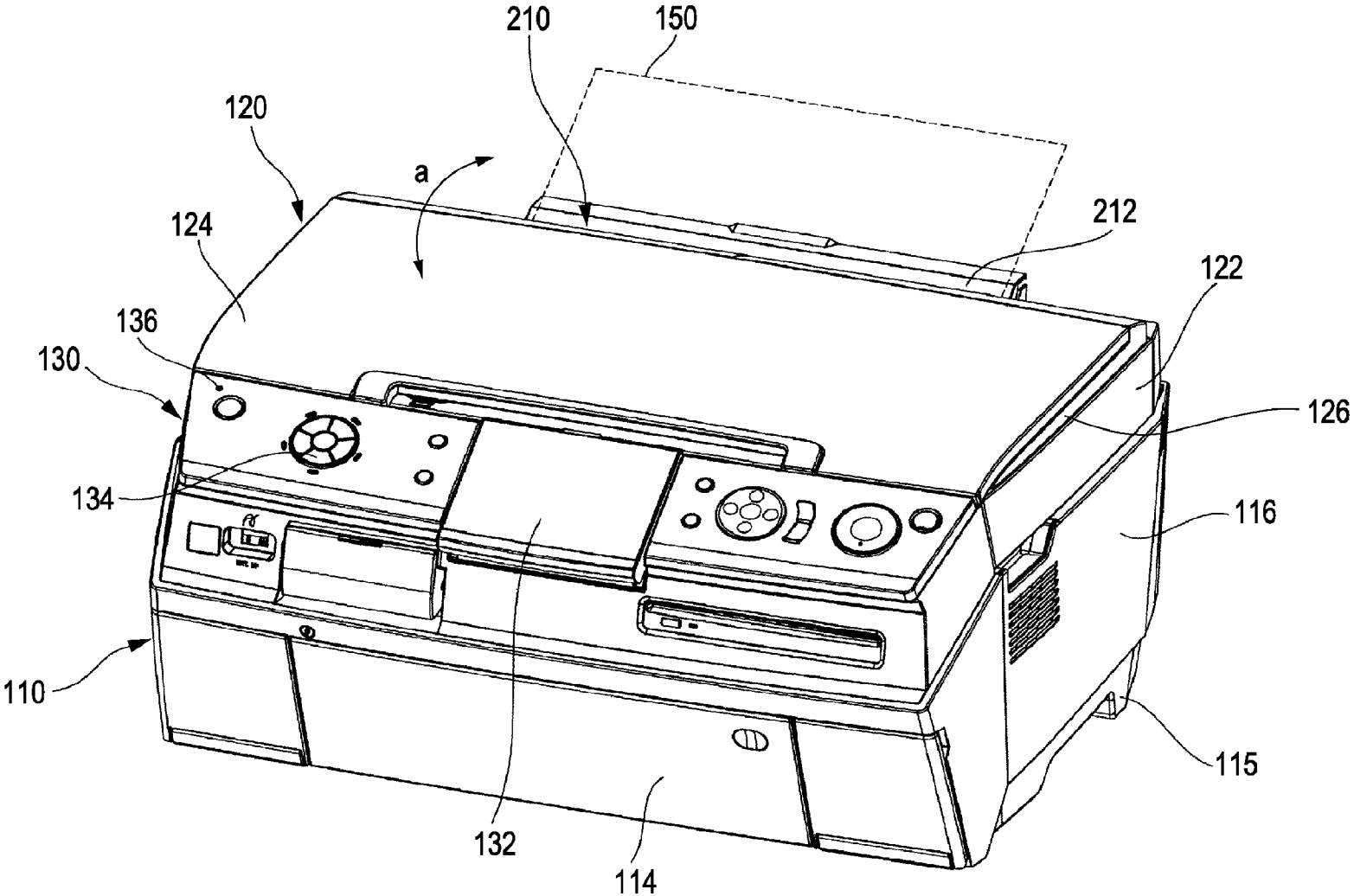
FIG. 1 is a perspective view showing an appearance of a recording-reading complex machine according to a first embodiment.

FIG. 1 is a perspective view showing an appearance of a recording-reading complex machine 100 which is a recording apparatus. As shown in FIG. 1, the recording-reading complex machine 100 is equipped with an in jet type recording unit 110, a reading unit 120, and an operation panel 130.

The ink jet type recording unit 110 is disposed above a case bottom 115 and the outside is covered by a lower case 116.

The reading unit 120 is disposed so as to be overlapped on the ink jet type recording unit 110 and the outside is covered by an upper case 122.

The operation panel 130 is provided at the front side on the upper surface of the recording-reading complex machine 100. The operation panel 130 is equipped with a plurality of operation buttons 134, a pilot lamp 136, and the like in addition to a display panel 132. The operation panel 130 is used for inputting various instructions when the recording-reading complex machine 100 is independently operated without connecting to an information processing device or the like. Further, the operation panel 130 displays an operation state and the like.

The ink jet type recording unit 110 is equipped with a feeding portion 210.

The feeding portion 210 is equipped with a paper support 212 and provided at the rear side of the lower case 116. Further, a front cover 114 is provided at the front surface of the lower case 116. A recording paper 150 which is a medium to be recorded fed on the paper support 212 is transported in the ink jet type recording unit 110 toward the front direction and an image is recorded while the transportation.

The reading unit 120 is equipped with an upper cover 124 attached so as to be able to be opened and closed in the direction shown by the arrow a in FIG. 1 and a reading table 126 disposed below the upper cover 124. When reading a manuscript with the reading unit 120, the upper cover 124 is opened and a manuscript is set on the reading table 126, and thereafter the upper cover 124 is closed. In this case, the manuscript is pressed by the upper cover 124, so that the surface to be read of such as a manuscript having winkles can be made contact with the reading table 126. An image of the manuscript is read out by the reading unit 120 by operating the operation panel 130 after the manuscript is set on the reading table 126 and the upper cover 124 is closed.

Figure 2:
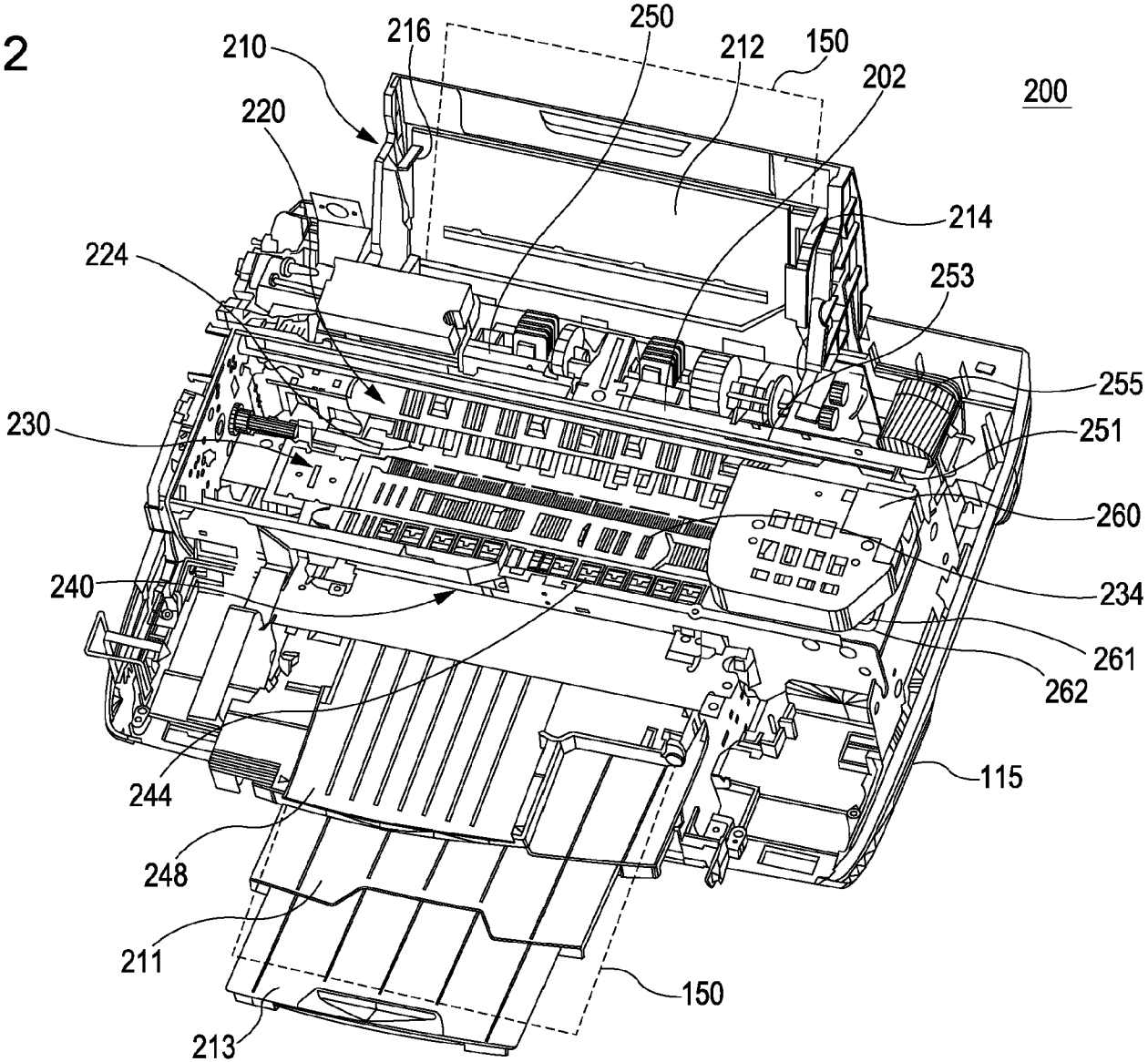
FIG. 2 is a perspective view showing an extracted ink jet type recording unit.

FIG. 2 is an extracted perspective view showing an inner mechanism 200 of the ink jet type recording unit 110 of the recording-reading complex machine 100 shown in FIG. 1. Further, FIG. 3 is a plan view showing the same inner mechanism 200 from the top view.

Figure 3:
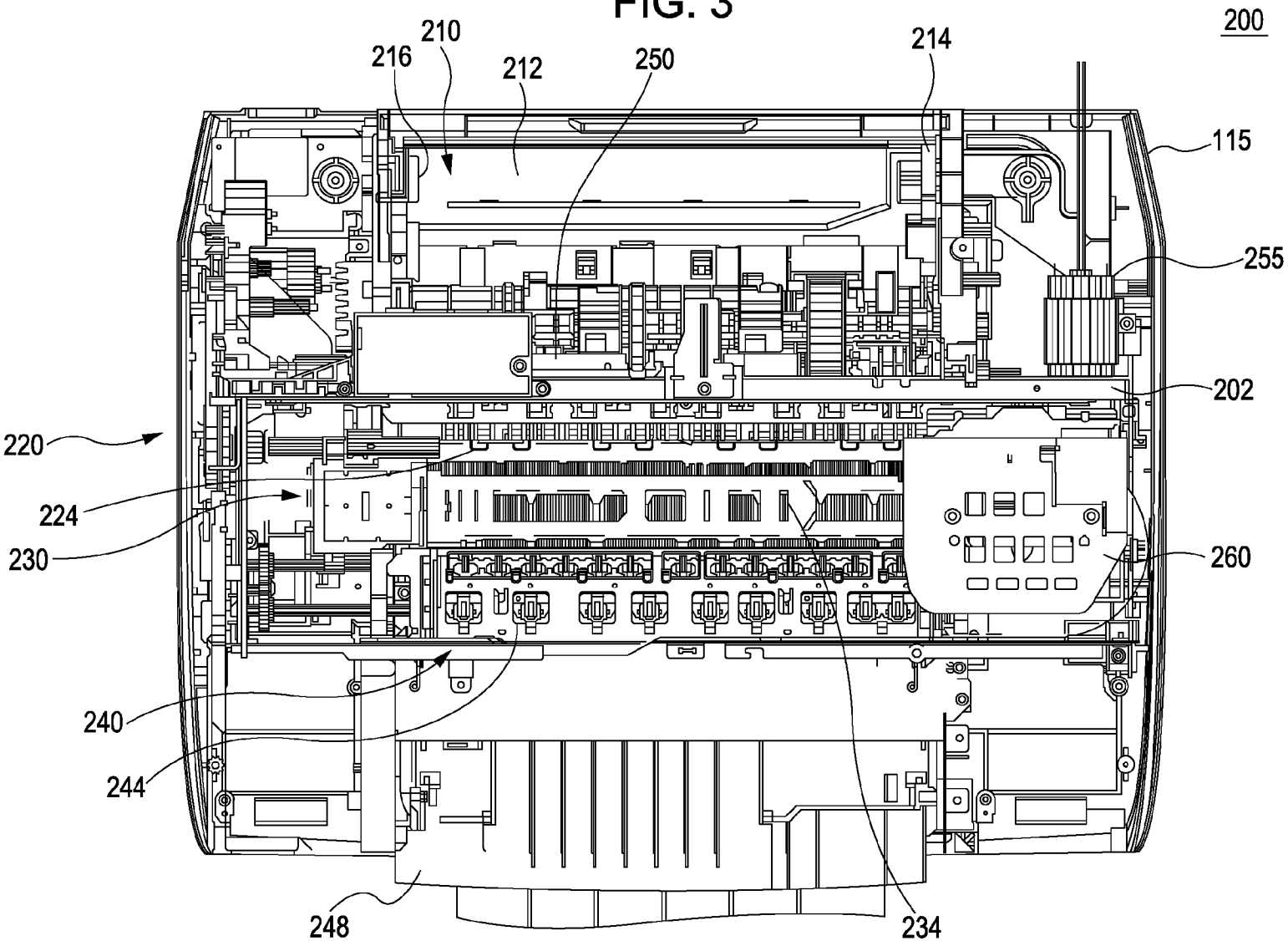
FIG. 3 is a plan view showing the ink jet type recording unit from top view.

As shown in FIGS. 2 and 3, the inner mechanism 200 is equipped with the case bottom 115, an approximately upright frame 202 provided on the case bottom 115, a feeding portion 210 disposed at the rear side of the frame 202, a transport portion 220, a platen 230, and an ejection portion 240 sequentially disposed at the front side of the frame 202.

The feeding portion 210 is equipped with the paper support 212 for supporting a back surface of the recording paper 150 when the recording paper is fed, a side support 214 for positioning the right side end of the recording paper 150, and a slide support 216 for preventing the recording paper 150 to lean by making contact with the left side edge of the recording paper 150.

The slid support 216 can be horizontally moved on the surface of the paper support 212. Accordingly, even when the recording paper 150 having a different width is fed, the slide support can be made contact with the side end of the recording paper 150.

Further, the feeding portion 210 is equipped with a feeding roller (not shown) attached on the back side of the frame 202. The feeding roller sends a plurality of recording papers 150 fed on the paper support 212 to the transport portion 220 side one by one.

The transport portion 220 is equipped with a transport driven roller 224 rotated by making contact with the upper surface of the recording paper 150 introduced by the feeding portion 210. A transport driving roller (not shown) rotatably driven by a transport motor (not shown) is disposed just under the transport driven roller 224. The transport portion 220 presses the recording paper 150 send from the feeding portion 210 to the transport driving roller by the transport driven roller 224 and intermittently transport the recording papers 150 to the upper side of the platen 230 by rotating the transport driving roller.

The platen 230 is equipped with a plurality of ribs 234 projecting toward upper direction. The distal ends of the ribs 234 are made contact with the lower surface of the recording paper 150 send on the platen 230. Herewith, the recording paper 150 is positioned on the platen 230 in the height direction. The structure of the platen 230 will be described later with reference to FIG. 4.

A carriage 260 is disposed on the upper side of the platen 230. The carriage 260 is attached to a guide rail (not shown) horizontally extending along the direction perpendicular to the direction in which the recording paper 150 is transported by the transport portion 220 and the like.

Further, a timing belt 253 is wound between a pair of pulleys 251 attached to the frame 202. The timing belt 253 is coupled with the back surface of the carriage 260.

When one of the pair of the pulleys 251 is rotatably driven by a carriage motor 255, the timing belt 253 horizontally moves the carriage 260 along the longitudinal direction of the guide rail. Accordingly, by controlling the operation and the rotating direction of the carriage motor 255, the carriage 260 can be moved on the upper side of any area on the platen 230.

A recording head 261 is disposed on the lower side of the carriage 260. Further, a nozzle plate 262 in which a plurality of openings 254 described below are formed is disposed on the lower surface of the recording head 261.

The recording head 261 is formed by a material such as a resin having insulation property. The nozzle plate 262 is formed by a material having corrosion resistance with respect to ink and conductive property. For example, gold, stainless, nickel or the like is used for the nozzle plate 262. When the recording paper 150 is transported on the upper side of the platen 230, the carriage 260 is moved back and forth on the recording paper 150 supported by the platen 230 while the intermittent transport by the transport portion 220 is interrupted. At this time, the nozzle plate 262 ejects ink to any area of the surface of the recording paper 150 through the openings 254 to adhere the ink thereto. In this way, an image is recorded on the whole surface of the recording paper 150.

The ejecting portion 240 is disposed at the opposite side of the transport portion 220 with respect to the platen 230 and equipped with an ejection driven roller 244, an ejection driving roller (not shown), an ejection tray 248, and the like. The ejection driven roller 244 is made contact with the upper surface of the recording paper 150 send form the platen 230 side to be rotated with the movement of the recording paper 150. The ejection driving roller is disposed just under the ejection driven roller 244 and is rotatably driven by a transport motor via a rotation transmission mechanism (not shown).

The ejecting portion 240 presses the recording paper 150 on which a recording is performed by the above recording operation send from the platen 230 side to the ejection driving roller by the ejection driven roller 244 and ejects the recording paper 150 to the ejection tray 248 side by rotating the ejection driving roller.

The ejection tray 248 is disposed at the back surface side of the front cover 114 shown in FIG. 1. When the front cover 114 is opened, the ejection tray 248 is flared outwardly in a horizontal state as shown in FIG. 2. The recording paper 150 ejected from the ejection portion 240 side is accumulated one by one on the ejection tray 248.

Further, a paper support 211 is attached to the ejection tray 248 as shown in FIG. 2. The paper support 211 supports the recording paper 150 ejected on the discharge tray 248 from the lower side. Further, the recording paper 150 can be transported into the transport portion 220 by feeding the recording paper 150 on the paper support 211 and by utilizing the feeding portion 210. Further, as shown in FIG. 2, the paper support 211 is further equipped with an extending portion 213. Accordingly, the recording paper 150 longer than the length of the paper support 211 in the longitudinal direction can be also supported.

Note that a control unit 250 for controlling a sequence of recording operations described above is mounted in the ink jet recording unit 110. The control unit 250 controls each portion containing an electric potential difference generator 400 described below of the ink jet recording unit 110 based on instruction input via an information processing device (not shown) connected to the recording-reading complex machine 100 or instruction input from the operation panel 130. Further, the control section 250 is also an interface which receives image information by which the ink jet type recording unit 110 performs recording. The image information received by the control unit 250 may includes, for example, information of a medium to be recorded such as resolution of recording image, recording quality such as number of color, size, material, or the like in addition to the information of the image.

Figure 4:
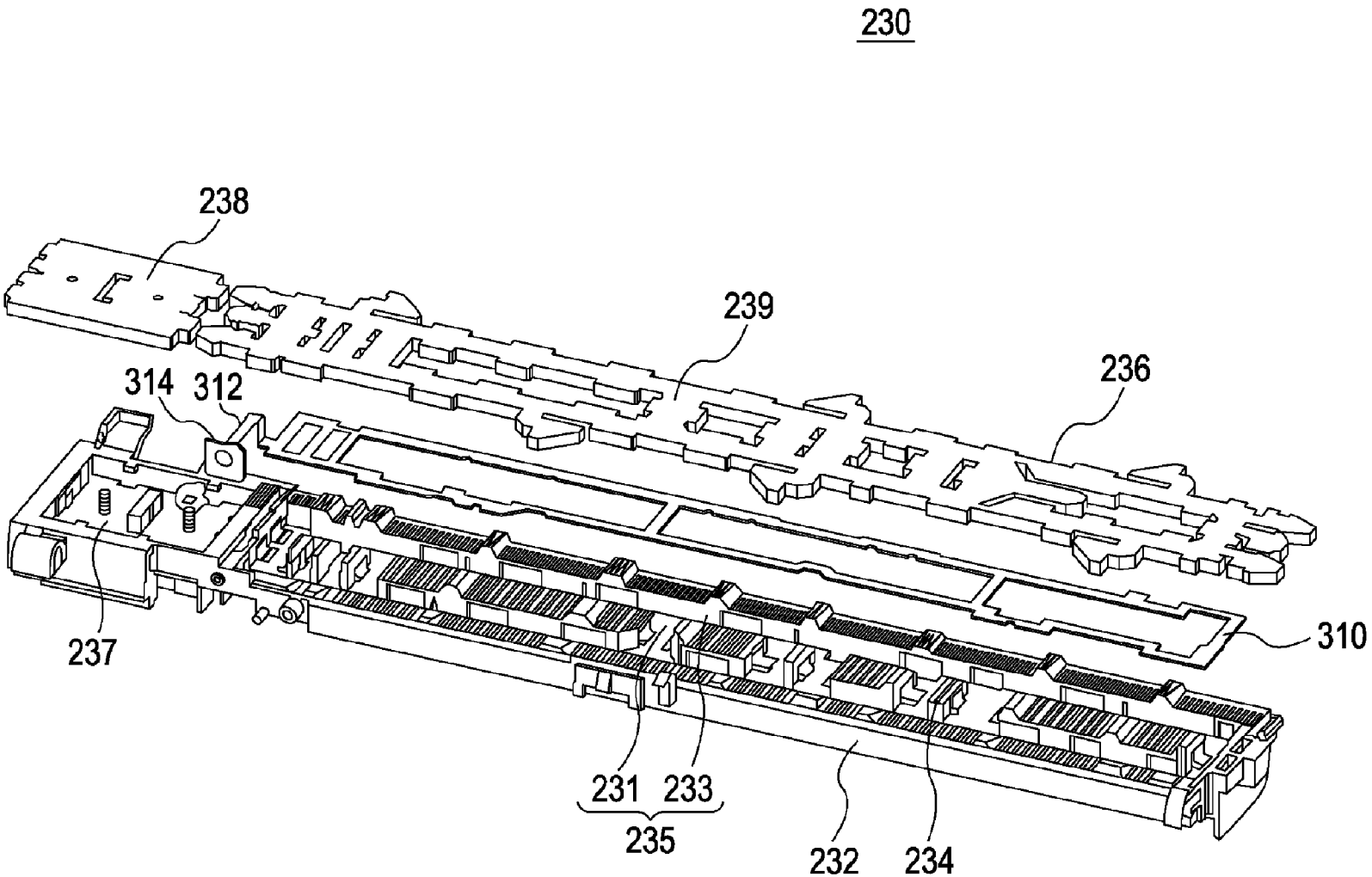
FIG. 4 is an exploded perspective view of a platen.

FIG. 4 is an exploded perspective view showing the platen 230.

As shown in FIG. 4, the platen 230 is equipped with a platen main body 232, an electrode 310 housed in the platen main body 232, and absorbing members 236, 238 formed by a material having insulation property.

The platen main body 232 is equipped with a plurality of ribs 234 projecting toward the upper side form the upper surface thereof, a housing 235 depressed from the upper surface and formed to include a bottom 231 and a side wall 233, and a housing 237 formed at the side of the housing 235.

As described above, when the paper 150 is transported on the upper side of the platen 230, the upper ends of the ribs 234 are made contact with the lower surface of the paper 150. The platen main body 232 is integrally formed and manufactured by a material, for example, such as a resin.

The absorbing member 236 is disposed in the housing 235 of the platen main body 232 and the absorbing member 238 is disposed in the housing 237 of the platen main body 232. The upper surface 239 of the absorbing member 236 disposed in the housing 235 is opposed to the nozzle plate 262 in the above described ejecting direction of ink. The absorbing members 236, 238 absorbs the ink not adhered to the recording paper 150 in the above recording operation. However, the amount of the ink which can be absorbed and stored is limited. Consequently, a waste liquid absorbing member having a capacity larger than the absorbing members 236, 238 may be separately provided on the lower side of the absorbing members 236, 238 in the platen 230. Further, it is preferable that the absorbing members 236, 238 absorb the ink adhered to the surface within a further short time. Accordingly, a material in which a resin such as polyethylene, polyurethane, or the like is foamed is used for the absorbing members 236, 238.

The electrode 310 is disposed below the absorbing members 236 inside the housing 235 and covers a part of the bottom 231 of the housing 235. Further, a connection 312 extending outwardly beyond the side wall 233 of the housing 235 and a terminal 314 exposed outside the platen 230 are integrally formed at one end of the electrode 310. The terminal 314 is electrically connected to the electric potential difference generator 400 as described below.

The electrode 310 is formed by a metal having corrosion resistance to ink, for example, such as a wire, a plate, or a foil made of gold, stainless, or nickel, or a wire, plate, or a foil coated by the metal, or a netted or grid member in which the materials are combined. Further, as another aspect, a coating layer, metallic layer, thick film layer, thin film layer or the like having conductive property directly formed on the bottom 231 of the housing 235 of the platen 230 can be also used as the electrode 310.

Figure 5:
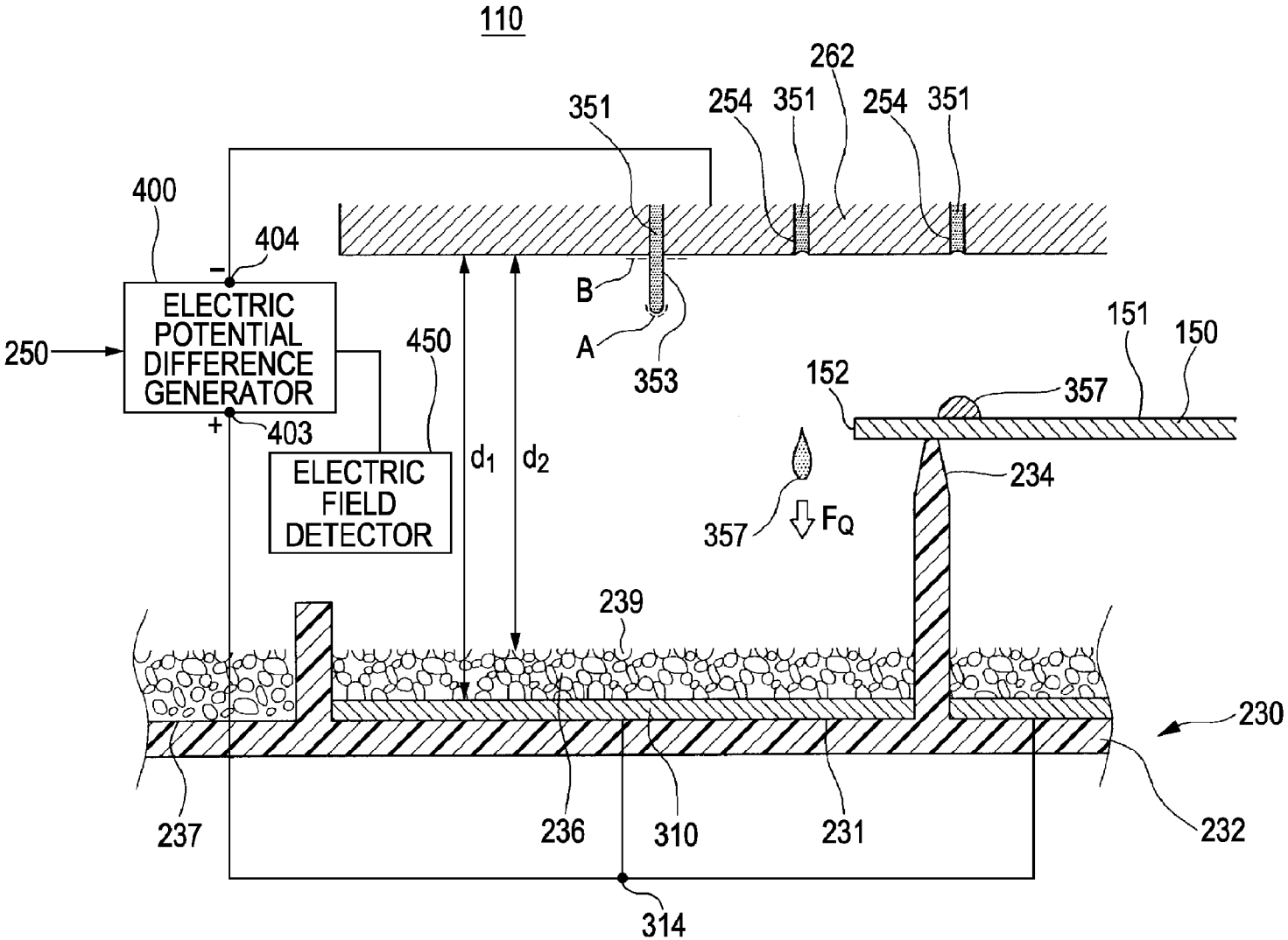
FIG. 5 is an enlarged view schematically showing the vicinity of a nozzle plate of the ink jet type recording unit.

FIG. 5 is an enlarged view schematically showing the vicinity of the nozzle plate 262 at the recording operation of the ink jet type recording unit 110. As shown in FIG. 5, the ink jet type recording unit 110 is further equipped with an electric potential difference generator 400 and an electric field detector 450.

The electric potential difference generator 400 is equipped with a positive electrode side terminal 403, a negative electrode side terminal 404, a direct current power source (not shown) electrically connected to the terminals, and the like. The positive electrode side terminal 403 of the electric potential difference generator 400 is electrically connected to the terminal 314 of the electrode 310 disposed between the platen main body 232 and the absorbing member 236. Further, the negative electrode side terminal 404 of the electric potential difference generator 400 is electrically connected to the nozzle plate 262. Further, the electric potential difference generator 400 is electrically connected to the control unit 250 shown in FIGS. 2 and 3 and an actuation signal or a stop signal is input from the control unit 250. The electric potential difference generator 400 generates an electric potential difference having magnitude of $V_0$ between the nozzle plate 262 and the electrode 310 when an actuation signal is input form the control unit 250. Further, the electric potential difference generator 400 stops generation of the electric potential difference when a stop signal is input from the control unit 250.

The electric potential difference generator 400 is further electrically connected to the electric field detector 450. The electric field detector 450 is disposed between the nozzle plate 262 and the upper surface 239 of the absorbing member 236. When an electric potential difference is generated by the electric potential difference generator 400, the electric field detector 450 detects a magnitude of the electric field generated by the electric potential difference between the nozzle plate 262 and electrode 310. Further, the electric field detector 450 outputs a signal corresponding to the magnitude of the detected electric field to the electric potential difference generator 400. The electric potential difference generator 400 detects the fluctuation of the magnitude of the electric field based on the signal input from the electric field detector 450 to control the magnitude $V_0$ of the electric potential difference generated between the nozzle plate 262 and the electrode 310 so that the fluctuation becomes smaller.

At the recording operation of the in jet type recording unit 110, when an electric potential difference having magnitude $V_0$ is generated between the nozzle plate 262 and the electrode 310 by the electric potential difference generator 400, an electric field whose magnitude is $V_0$/d1 is generated between the nozzle plate 262 and the electrode spaced apart by distance $d_1$ as shown in FIG. 5 when no ink is absorbed by the absorbing member 236 as the absorbing member 236 of the platen 230 is formed by a material having insulation property.

In the state where the electric field is generated, when the ink 351 adheres to the recording surface 151 of the recording paper 150 so that no margin is remained in the marginal part 152, the nozzle plate 262 ejects the ink 351 on the lower side through the opening 254 on the upper side of the vicinity of the marginal part 152 of the recording paper 150. The ejected ink droplet 357 adheres to the recording surface 151 of the recording paper 150 to form a part of an image when the recording paper 150 exists just under the opening 254. On the contrary, there is a case in that the nozzle plate 262 ejects the ink 351 through the opening 254 outside the marginal part 152 of the recording paper 150. In such a case, there is no recording paper 150 just under the opening 254, so that the ejected ink droplet 357 falls to the lower side without adhering to the recording surface 151 of the recording paper 150. Herein, a gravitational force is applied in the downward direction by the self weight, and on the other hand, a force is applied in the direction opposite to the gravitational force by the viscosity resistance of atmosphere. The weight of the ink droplet 357 is extremely small, so that the gravitational force and the force by the viscosity resistance applied to the ink droplet 357 become approximately equal. Consequently, the ink droplets 357 float in the air. This phenomenon is called as aerosol.

Incidentally, the ink 351 extruded from the opening 254 of the nozzle plate 262 forms an ink column 353 drooped from the nozzle plate 262 at the moment right before the ink 351 leaves the nozzle plate 262 to be the ink droplet 357. Further, the electric potential difference generator 400 generates electric potential difference $V_0$ between the nozzle plate 262 and the electrode 310, so that the nozzle plate 262 is negatively charged. Accordingly, an electric charge is accumulated between the distal end A of the ink column 353 and the area B near the ink column 353 at the lower surface of the nozzle late 262 by so called lightning rod effect.

By the lighting rod effect, the ink droplet 357 is charged to the same (negative) electrode as the nozzle plate 262 by the electric charge larger than the electric charge corresponding to the horizontal cross-section area of the ink column 353. Note that the lighting rod effect is a phenomenon in which the surface area B of the nozzle plate 262 surrounded by a cone shape whose apex is distal end A (lower end in FIG. 5) of the ink column 353 and whose apex angle is 50 degrees to 60 degrees contributes to the charge of the ink droplet 357. A coulomb force (a force shown by the arrow "$F_Q$" in FIG. 5) whose magnitude is proportional to the magnitude of the own electric charge and the magnitude ($V_0/d_1$) of the electric field is applied to the charged ink droplet 357 in the direction of the electrode 310 reversely (positively) charged with respect to the own electric charge. Herein, the magnitude ($V_0/d_1$) of the electric field is set to, for example, a fixed intensity $E_0$.

When the magnitude ($V_0/d_1$) of electric field is $E_0$, a coulomb force by which the ink droplet 357 can be surely attracted in the direction of the electrode 310 against the force of the viscosity resistance of the atmosphere is applied. Accordingly, the ink droplet 357 not adhered to the upper surface of the recording paper 150 adheres to the absorbing member 236 disposed on the upper side of the electrode 310 without floating to be absorbed inside the absorbing member 236 by capillary action. Note that the magnitude of the electric field $E_0$ is a degree by which no breakdown is generated between the nozzle plate 262 and the electrode 310.

Herein, the absorbing member 236 becomes a state in which the ink 351 is absorbed to the upper surface 239 (hereinafter, the state is referred to as "absorption saturated state") by repeating the recording operation at the vicinity of the marginal part 152 of the recording paper 150 by the ink jet system recording unit 110. Herein, the ink 51 is an electrolytic solution in which an electrolyte is dissolved and has conductive property also in the state where the ink 351 is absorbed inside the absorbing member 236. When the absorbing member 236 becomes in the absorption saturated state, the electric field having magnitude of $V_0/d_2$ is generated between the nozzle plate 262 and the upper surface 239 of the absorbing member 236 spaced apart by the distance $d_2$ shown in FIG. 2. This is because the electrode 310 and the upper surface 239 of the absorbing member 236 become equipotent as the ink 351 absorbed in the absorbing member 236 has conductive property.

In this manner, the distance of the electric field generated between the nozzle plate 262 and the electrode 310 when an electric potential difference is generated by the electric potential difference generator 400 is different according to whether the ink 351 is absorbed by the absorbing member 236 or not. Accordingly, when the magnitude $V_0$ of the electric potential difference generated by the electric potential difference generator 400 between the nozzle plate 262 and electrode 310 is a fixed value, the magnitude of the electric field becomes larger when the ink 351 is absorbed by the absorbing material 236 than when the ink 351 is not absorbed.

Herein, the electric potential difference generator 400 receives an input signal in accordance with the magnitude of the electric field from the electric field detector 450 and detects the fluctuation of the magnitude of the electric field fluctuated as the ink 351 is absorbed by the absorbing member 236 to reduce the magnitude $V_0$ of the electric potential difference generated between the nozzle plate 262 and the electrode 310. Accordingly, the magnitude $V_0/d_1$ of the electric field when the ink 351 is not absorbed in the absorbing member 236 and the magnitude $V_0/d_2$ of the electric field when the ink 351 is absorbed in the absorbing member 236 are controlled to the same magnitude.

In this manner, the ink jet type recording unit 110 makes it possible to reduce the fluctuation of the magnitude of the electric field by detecting the electric field generated by the electric potential difference generated between the nozzle plate 262 and the electrode 310 by the electric field detector 450 and by controlling the magnitude of the electric potential difference by the electric potential difference generator 400. Note that a similar function can be provided when all of the polarities are reversed.

According to such an embodiment, effects described below can be obtained.

(1) The fluctuation of the magnitude of the electric field generated by the electric potential difference generated between the nozzle plate 262 and the electrode 310 can be reduced, so that the magnitude of the electric field generated by the electric potential difference $V_0$ does not become too large when the distance between the nozzle plate 262 and a portion of the absorbing member 236 to which the ink is absorbed becomes short. Accordingly, occurrence of breakdown between the nozzle plate 262 and the absorbing member 236 can be prevented. Further, it can be prevented that the ink droplet 357 not adhered to the recording paper 150 is accelerated by the too large electric field to collide at a portion of the absorbing member 236 in which the ink 351 is absorbed, thereby causing aerosol to fly peripherally to stain the nozzle plate 262 and the like.

(2) The fluctuation of the magnitude of the electric field generated between the nozzle plate 262 and the electrode 310 can be further reduced.

Second Embodiment

Figure 6:
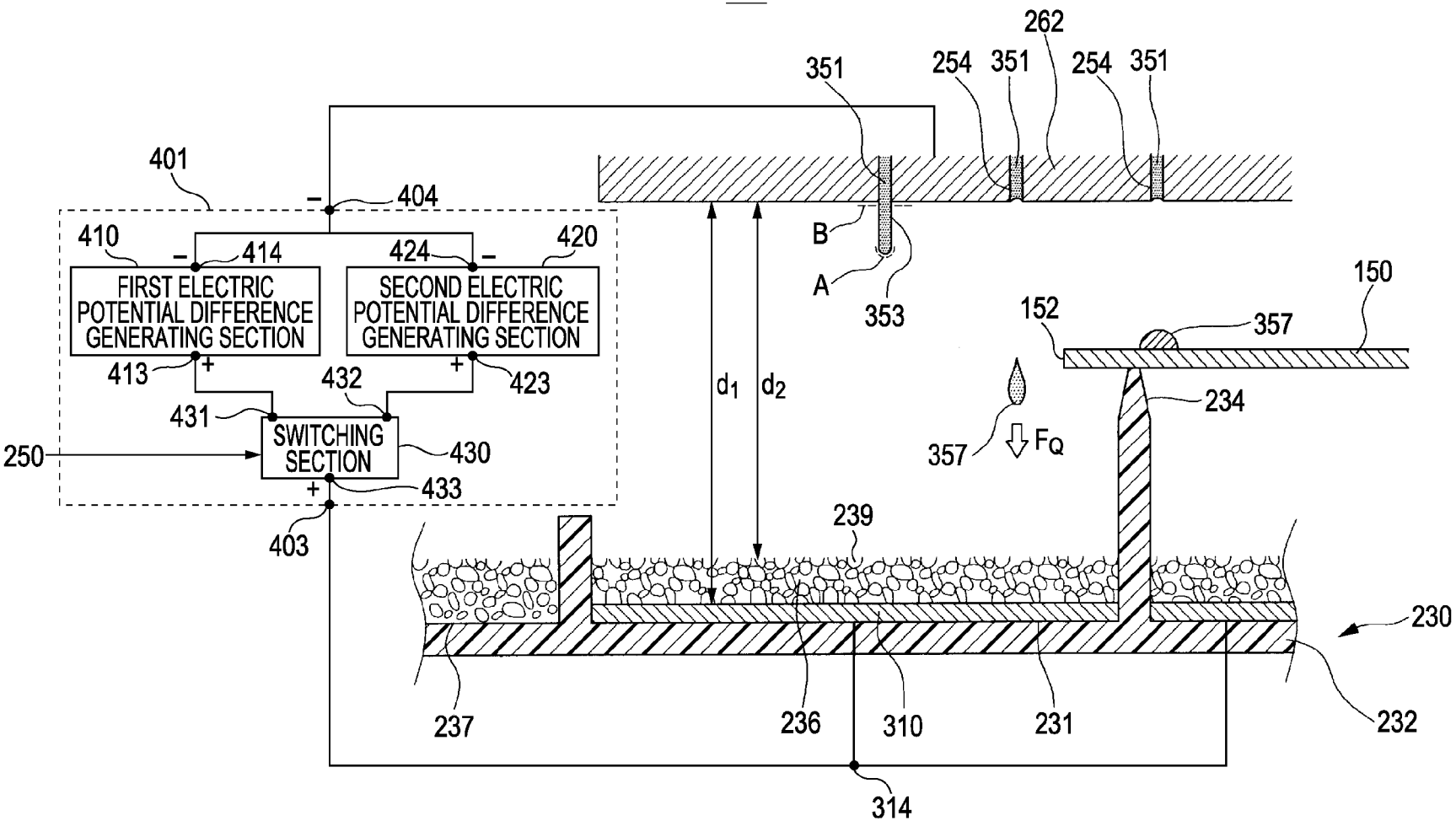
FIG. 6 is an enlarged view schematically showing the vicinity of a nozzle plate of an ink jet type recording unit according to a second embodiment.

FIG. 6 is an enlarged view schematically showing the vicinity of the nozzle plate 262 at recording operation by an ink jet type recording unit 111. Note that the same reference numerals as in FIG. 5 denote the same elements in FIG. 6, so that the description will be omitted.

As shown in FIG. 6, the ink jet type recording unit 111 is equipped with an electric potential difference generator 401 instead of the electric potential difference generator 400 and the electric field detector 450 of the ink jet type recording unit 110. The electric potential difference generator 401 includes a positive electrode side terminal 403, a negative electrode side terminal 404, a first electric potential difference generating section 410, a second electric potential difference generating section 420, and a switching section 430.

The first electric potential difference generating section 410 includes a positive electrode side terminal 413, a negative electrode side terminal 414, a direct current power source (not shown) electrically connected to the terminals, and the like. The second electric potential difference generating section 420 includes a positive electrode side terminal 423, a negative electrode side terminal 424, a direct current power source (not shown) electrically connected to the terminals, and the like. The switching section 430 includes terminals 431, 432, 433, a changing-over switch (not shown), and the like. For example, a relay, a semiconductor switch, or the like is used for the changing-over switch.

The negative electrode side terminal 414 of the first electric potential difference generating section 410 is electrically connected to the negative electrode side terminal 404 of the electric potential difference generator 401 and the positive electrode side terminal 413 of the first electric potential difference generating section 410 is electrically connected to the terminal 431 of the switching section 430. Further, the negative electrode side terminal 424 of the second electric potential difference generating section 420 is electrically connected to the negative electrode side terminal 404 of the electric potential difference generator 401 and the positive electrode side terminal 423 of the second electric potential difference generating section 420 is electrically connected to the terminal 432 of the switching section 430. Further, the terminal 433 of the switching section 430 is electrically connected to the positive electrode side terminal 403 of the electric potential difference generator 401. The switching section 430 is further electrically connected to the control unit 250.

When detected that the ink 351 is not absorbed in the absorbing member 236, the control unit 250 outputs a first switching signal to the switching section 430. When the first switching signal is input, the switching section 430 electrically connects the terminal 431 and the terminal 433. Herewith, the positive electrode side terminal 413 of the first electric potential difference generating section 410 and the positive electrode side terminal 403 of the electric potential difference generator 401 are electrically connected and the first electric potential difference generating section 410 generates the electric potential difference having the fixed magnitude $V_1$ between the nozzle plate 262 and the electrode 310. By the electric potential difference $V_1$, the electric field having the magnitude $V_1/d_1$ is generated between the nozzle plate 262 and the electrode 310 spaced apart by the distance $d_1$ shown in FIG. 6.

On the contrary, when detected that the ink 351 is absorbed in the absorbing member 236 to the absorption saturated state, the control unit 250 output a second switching signal to the switching section 430. When the second switching signal is input, the switching section 430 electrically connects the terminal 432 and the terminal 433. Herewith, the positive electrode side terminal 423 of the second electric potential difference generating section 420 and the positive electrode side terminal 403 of the electric potential difference generator 401 are electrically connected and the second electric potential difference generating section 420 generates the electric potential difference having a fixed magnitude $V_2$ between the nozzle plate 262 and the electrode 310. By the electric potential difference $V_2$, the electric field having the magnitude $V_2/d_2$ is generated between the nozzle plate 262 and the electrode 310 spaced apart by the distance $d_2$ shown in FIG. 6.

Herein, the magnitude $V_1$ of the electric potential difference generated by the first electric potential difference generating section 410 between the nozzle plate 262 and the electrode 310 is set so that the magnitude $V_1/d_1$ of the electric field generated by the electric potential difference $V_1$ and the magnitude $E_0$ of the electric field become approximately the same.

Further, the magnitude $V_2$ of the electric potential difference generated by the second electric potential difference generating section 420 between the nozzle plate 262 and the electrode 310 is set so that the magnitude $V_2/d_2$ of the electric field generated by the electric potential difference $V_2$ and the magnitude $V_1/d_1$ of the electric field become approximately the same. Note that a similar function can be provided when all of the polarities are reversed.

Note that in the ink jet type recording unit 111, as means for detecting whether the ink 351 is absorbed by the absorbing member 236 or not by the control unit 250, for example, means for detecting the fluctuation by detecting the weight of the absorbing member 236 by a road cell, means for detecting the amount of the ink 351 absorbed by the absorbing member 236 by using a water detecting sensor disposed in the height direction of the absorbing member 236, or the like is used.

According to such an embodiment, effects described below can be obtained.

(3) The ink droplet 357 ejected from the opening 254 of the nozzle plate 262 and not adhered to the upper surface of the recording paper 150 adheres to the absorbing member 236 disposed on the upper side of the electrode 310 without floating also at the recording operation by the ink jet type recording unit 111 similarly to at the recording operation by the ink jet type recording unit 110.

(4) It can be prevented that the magnitude $V_2/d_2$ of the electric field becomes to large even when the distance between a portion of the absorbing member 236 to which the ink 351 is absorbed by the absorbing member 236 and the nozzle plate 262 comes close. Accordingly, occurrence of breakdown between the nozzle plate 262 and the absorbing member 236 can be prevented.

Third Embodiment

Figure 7:
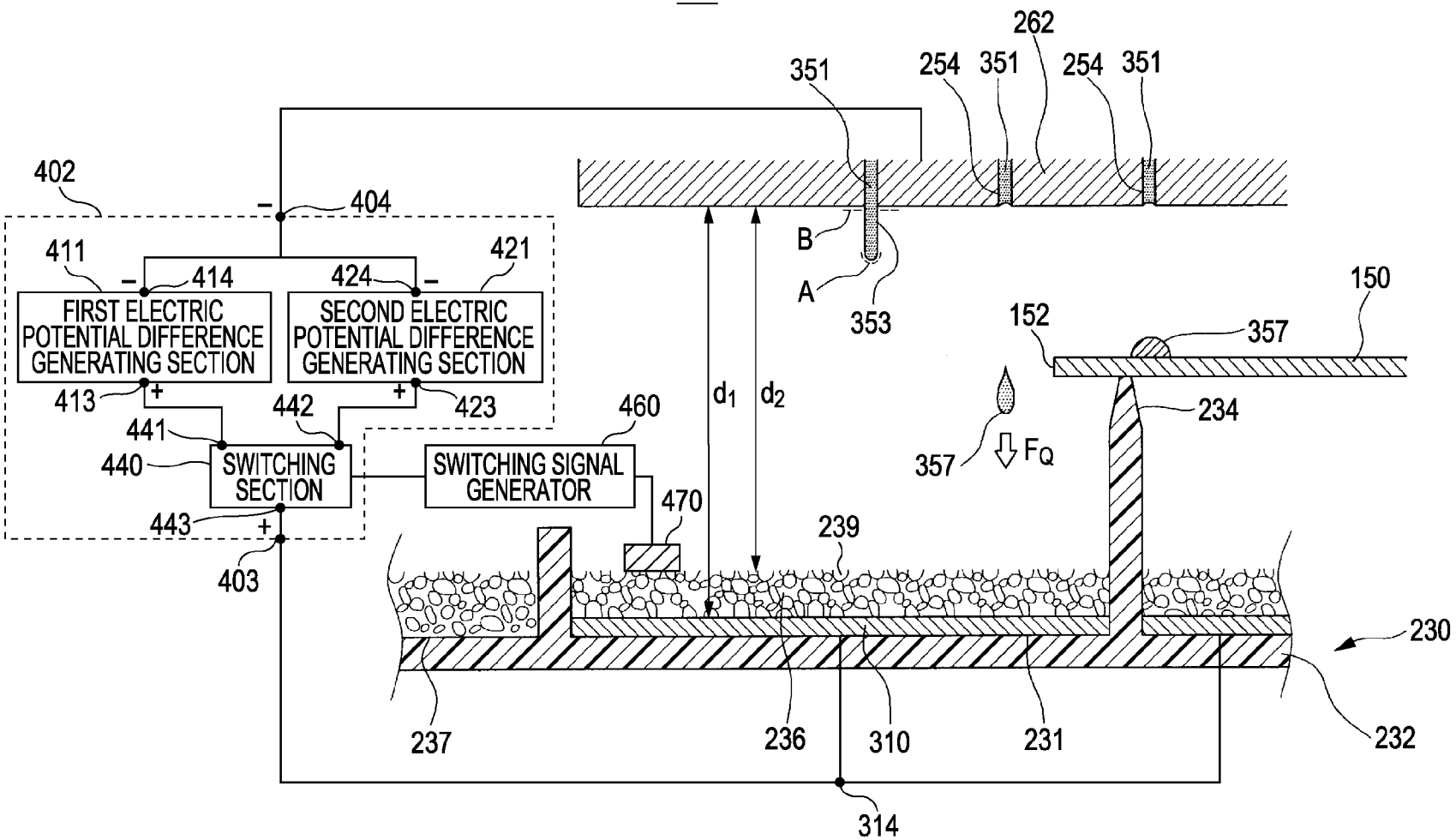
FIG. 7 is an enlarged view schematically showing the vicinity of a nozzle plate of an ink jet type recording unit according to a third embodiment.

FIG. 7 is an enlarge view schematically showing the vicinity of the nozzle plate 262 at recording operation by an ink jet type recording unit 112. Note that the same reference numerals as in FIG. 6 denote the same elements in FIG. 7, so that the description will be omitted. As shown in FIG. 7, the ink jet type recording unit 112 is equipped with an electric potential difference generator 402, a surface electrode 470, and a switching signal generator 460 instead of the electric potential difference generator 401 of the ink jet type recording unit 111.

The electric potential difference generator 402 is equipped with a positive electrode side terminal 403, a negative electrode side terminal 404, a first electric potential difference generating section 411, a second electric potential difference generating section 421, and a switching section 440. The first electric potential difference generating section 411 and the second electric potential difference generating section 421 of the electric potential difference generator 402 have the structure similar to the first electric potential difference generating section 410 and the second electric potential difference generating section 420 of the electric potential difference generator 401 of the ink jet type recording unit 111 shown in FIG. 6. The switching section 440 includes terminals 441, 442, 443, a changing-over switch (not shown), and the like. For example, a relay, a semiconductor switch, or the like is used for the changing-over switch. The surface electrode 470 is disposed at the nozzle plate 262 side of the absorbing member 236 and made contact with the upper surface 239 of the absorbing member 236.

The negative electrode side terminal 414 of the first electric potential difference generating section 411 is electrically connected to the negative electrode side terminal 404 of the electric potential difference generator 402 and the positive electrode side terminal 413 of the first electric potential difference generating section 411 is electrically connected to the terminal 441 of the switching section 440. Further, the negative electrode side terminal 424 of the second electric potential difference generating section 421 is electrically connected to the negative electrode side terminal 404 of the electric potential difference generator 402 and the positive electrode side terminal 423 of the second electric potential difference generating section 421 is electrically connected to the terminal 442 of the switching section 440. Further, the terminal 443 of the switching section 440 is electrically connected to the positive electrode side terminal 403 of the electric potential difference generator 402. The switching signal generator 460 is electrically connected to each of the switching section 440 and the surface electrode 470.

The switching signal generator 460 detects whether a portion of the absorbing member 236 to which the ink is absorbed therein reached the upper surface 239 via the surface electrode 470. When the surface electrode 470 is not made contact with a portion of the absorbing member 236 to which the ink is absorbed, the switching signal generator 460 outputs a first switching signal to the switching section 440. The switching section 440 electrically connects the terminal 441 and the terminal 443 when the first switching signal is input from the switching signal generator 460. Herewith, the positive electrode side terminal 413 of the first electric potential difference generating section 411 and the positive electrode side terminal 403 of the electric potential difference generator 402 are electrically connected and the first electric potential difference generating section 411 generates the electric potential difference having a fixed magnitude $V_1$ between the nozzle plate 262 and the electrode 310. By the electric potential difference $V_1$, the electric field having a magnitude $V_1/d_1$ is generated between the nozzle plate 262 and the electrode 310 spaced apart by the distance $d_1$ shown in FIG. 7.

On the contrary, when detected that the surface electrode 470 is made contact with a portion of the absorbing member 236 to which the ink is absorbed therein, the switching signal generator 460 outputs a second switching signal for instructing to switch to the second electric potential difference generating section 421 to the switching section 440. When the second switching signal is input from the switching signal generator 460, the switching section 440 electrically connects the terminal 442 and the terminal 443. Herewith, the positive electrode side terminal 423 of the second electric potential difference generating section 421 and the positive electrode side terminal 403 of the electric potential difference generator 402 are electrically connected and the second electric potential difference generating section 421 generates the electric potential difference having a fixed magnitude $V_2$ between the nozzle plate 262 and the electrode 310. By the electric potential difference $V_2$, the electric field having the magnitude $V_2/d_2$ is generated between the nozzle plate 262 and the electrode 310 spaced apart by the distance $d_2$ shown in FIG. 7.

Herein, the magnitude $V_1$ of the electric potential difference generated by the first electric potential difference generating section 411 between the nozzle plate 262 and the electrode 310 is set so that the magnitude $V_1/d_1$ of the electric field generated by the electric potential difference $V_1$ and the magnitude $E_0$ of the electric field become approximately the same.

Further, the magnitude $V_2$ of the electric potential difference generated by the second electric potential difference generating section 421 between the nozzle plate 262 and the electrode 310 is set so that the magnitude $V_2/d_2$ of the electric field generated by the electric potential difference $V_2$ and the magnitude $V_1/d_1$ of the electric field become approximately the same. In this manner, the ink jet type recording unit 112 is equipped with the surface electrode 470 and the switching signal generator 460 which detects whether a portion of the absorbing member 236 to which the ink is absorbed reached the upper surface 239 or not via the surface electrode 470 and outputs a signal to switch the first electric potential difference generating section 411 and the second electric potential difference generating section 421.

According to such an embodiment, effects described below can be obtained.

(5) The ink droplet 357 ejected from the opening 254 of the nozzle plate 262 and not adhered to the upper surface of the recording paper 150 adheres to the absorbing member 236 disposed on the upper side of the electrode 310 without floating also at the recording operation by the ink jet type recording unit 112 similarly to at the recording operation by the ink jet type recording unit 110.

(6) Occurrence of breakdown between the nozzle plate 262 and the absorbing member 236 can be prevented even when the distance between a portion of the absorbing member 236 to which the ink 351 is absorbed by the absorbing member 236 and the nozzle plate 262 become the most close as shown by $d_2$ in FIG. 7 as the magnitude $V_2/d_2$ of the electric field does not become too large. Note that a similar function can be provided when all of the polarities are reversed.

(7) It can be prevented that the magnitude of the electric field becomes too large even when accumulated hours of recording becomes long and the distance between a portion of the absorbing member 236 to which the ink 351 is absorbed by the absorbing member 236 and the nozzle plate 262 becomes the closest distance.

Fourth Embodiment

Figure 8:
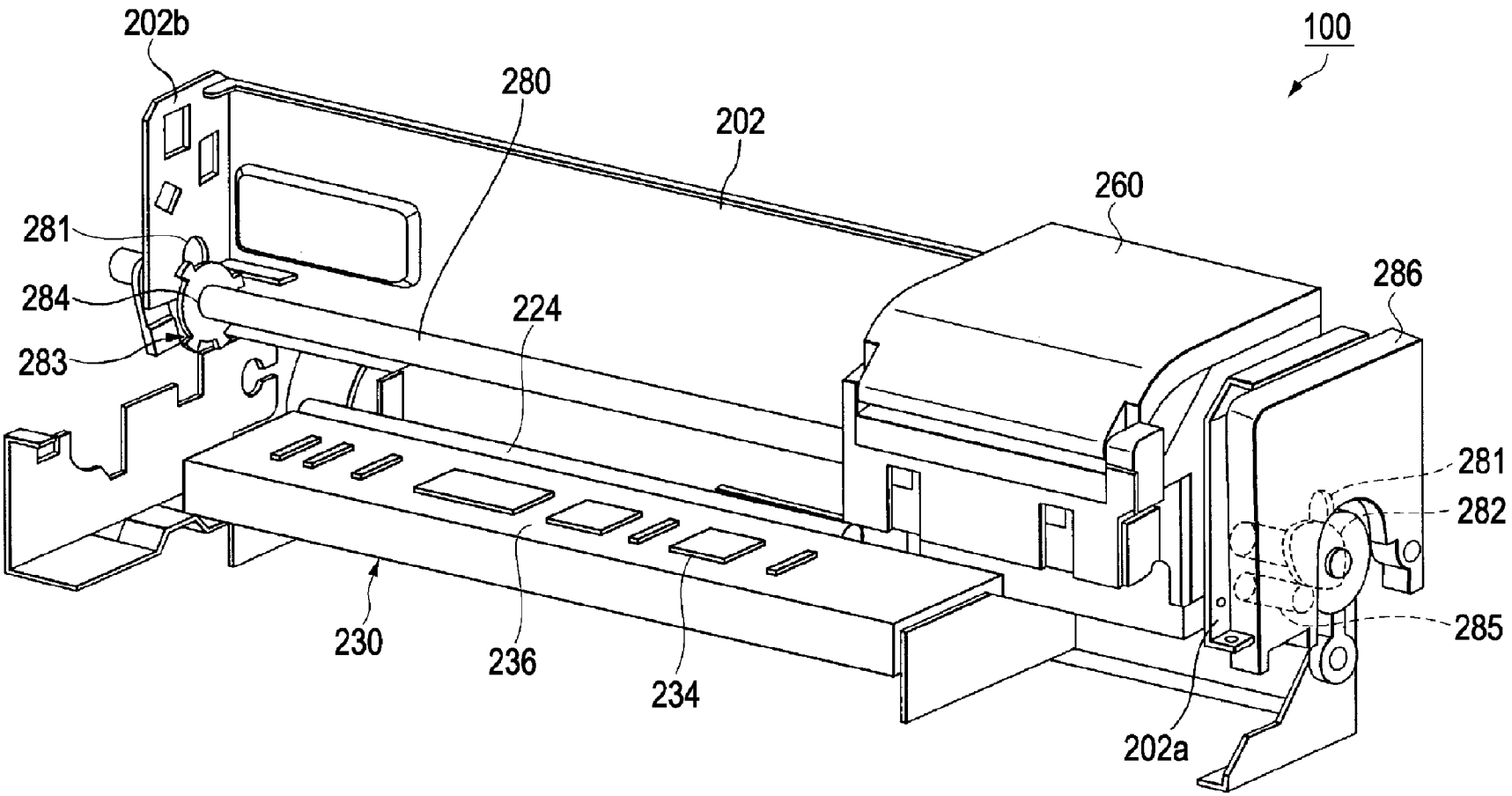
FIG. 8 is a perspective view showing the vicinity of a frame according to a fourth embodiment.

FIG. 8 is a perspective view showing the vicinity of the frame 202 of the recording-reading complex machine 100 of the embodiment.

The recording-reading complex machine 100 according to the embodiment is equipped with a mechanism for adjusting the distance between the platen 230 and the nozzle plate 262 shown in FIG. 2, so called a platen gap, in accordance with the thickness of the recording paper 150 shown in FIG. 1.

In FIG. 8, a guide rail 280 is attached to the frame 202. The guide rail 280 is supported by a race 281 provided in a right side frame 202*a* and a race 281 provided in a left side frame 202*b*. A carriage 260 is mounted on the guide rail 280 and the carriage 260 moves along the guide rail 280.

The guide rail 280 is provided so as to be moved along the races 281. A concrete moving mechanism will be described below.

A gap adjusting cam 282 is provided at a portion outside the right side frame 202*a* of the guide rail 280 and the outer circumference thereof is made contact with a fixing pin 285.

The distance between the outer circumference of the gap adjusting cam 282 made contact with the fixing pin 285 and the rotating axis of the guide rail 280 is changed by rotation of the guide rail 280. With the rotation, the guide rail 280 is moved along the race 281 and the carriage 260 is also moved, and the adjustment of the platen gap is performed. The gap adjusting cam 282 and the like are covered by a cover 286.

The degree of the platen gap may be changed by rotating the guide rail by a motor in accordance with the information according to the thickness of the recording paper 150 from an external computer or may be chanted to a predetermined position by hand.

Figure 9:
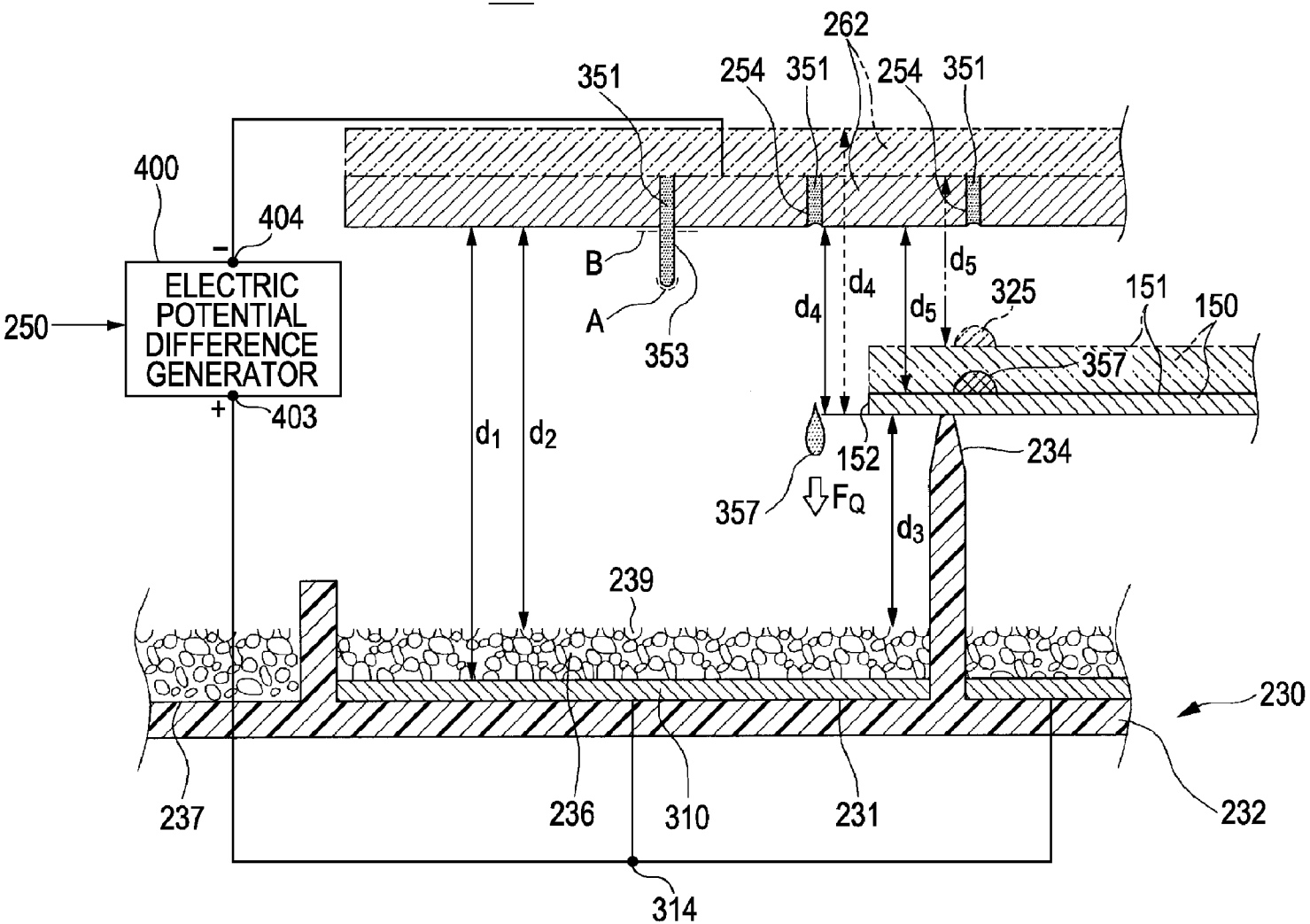
FIG. 9 is an enlarge view schematically showing the vicinity of a nozzle plate of an ink jet type recording unit.

FIG. 9 is an enlarged view schematically showing the vicinity of the nozzle plate 262 at the recording operation by the ink jet type recording unit 110. Note that the same reference numerals as the first embodiment shown in FIG. 5 denote the same elements in FIG. 9, so that the description will be omitted. $d_4$ denotes a platen gap and $d_3$ denotes a distance between the upper surface 239 of the absorbing member 236 and the distal end of the rib 234. A state of the recording paper 150 and the nozzle plate 262 when the thickness of the recording paper 150 is thick is shown by a two dotted chain line in FIG. 9. The position of the nozzle plate 262 with respect to the platen 230 is adjusted by the above described mechanism in accordance with the thickness of the recording paper 150. To be more specific, the length $d_4$ of the platen gap becomes long as the thickness of the recording paper 150 becomes thick. The distance $d_5$ from the recording surface 151 of the recording paper 150 to the nozzle plate 262 is kept at approximately the same distance by the adjustment.

In the embodiment, a command is made to the electric potential difference generator 400 from the control unit 250 in accordance with the platen gap $d_4$ and the electric potential difference is generated by applying a voltage between the nozzle plate 262 and the electrode 310 by the electric potential difference generator 400.

Relations between the type of recording paper 150, $d_3$, $d_4$, applied voltage, and electric field intensity are shown in Table 1. The electric field intensity is set to be approximately fixed magnitude $E_0$. Breakdown does not occur between the nozzle plate 262 and the electrode 310 by the degree of the magnitude $E_0$.

TABLE 1

| Type of medium | d3 (mm) | d4 (mm) | Applied voltage (V) | Electric field intensity (KV/m) |
|---|---|---|---|---|
| Normal paper | 3 | 1.7 | 300 | 64 |
| | 3 | 2.1 | 400 | 78 |
| Dedicated paper | 3 | 1.7 | 400 | 85 |
| Gloss paper | 3 | 1.2 | 400 | 95 |
| Mat paper | 3 | 1.7 | 400 | 85 |
| Gloss film | 3 | 1.2 | 400 | 95 |
| OHP sheet | 3 | 1.2 | 400 | 95 |
| Sticker sheet | 3 | 1.2 | 400 | 95 |
| Board paper • CDR | 3 | 4.5 | 700 | 93 |

Approximately fixed electric field intensity can be obtained by varying the applied voltage in accordance with the platen gap $d_4$. Accordingly, even when the platen gap $d_4$ is changed, the ink droplet 357 ejected from the opening 254 of the nozzle plate 262 and not adhered to the upper surface of the recording paper 150 is stably adhered to the absorbing member 236 disposed on the upper side of the electrode 310 without floating.

Information of the platen gap $d_4$ may be obtained based on the information of the type of the recording paper 150 input via an information processing device or the like connected to the recording-reading complex machine 100 or the information input from the operation panel 130. Alternatively, the platen gap $d_4$ may be electrically or mechanically detected.

Further, as for the method for applying a voltage between the nozzle plate 262 and the electrode 310, the method in which a plurality of electric potential difference generating sections are provided and selects one of the electric potential difference generating sections by a switching section to vary the voltage to be applied as shown in the second and third embodiments may also be applied.

According to such an embodiment, effects described below can be obtained.

(8) In addition to the effects described above, even when the recording paper 150 having a different thickness is used, the distance between the recording surface 151 and the nozzle plate 262 is set to an approximately fixed distance. Accordingly, the recording-reading complex machine 100 which makes it possible to reduce the positional misalignment of the ink on the recording surface 151 and to provide stable recording image quality can be obtained.

(9) Deterioration of collecting efficiency of the aerosol formed by the ink droplet 357 can be reduced even when the recording paper 150 having a different thickness is used.

Note that in the recording-reading complex machine 100, instead of the electric field detector 450, or in addition thereto, a time measuring portion for measuring time from starting of recording by the ink jet type recording unit 110 may be further provided. When the time from starting of recording becomes long, the ejection amount of ink also increases, so that the electric potential difference generator 400 may generates a small electric potential difference as the time measured by the time measuring portion becomes long.

Further, the invention is not limited to the above described embodiments and various modifications can be made without departing from the spirit of the invention.

The ink jet type recording apparatus mounted as the ink jet type recording unit 110 of the recording-reading complex machine 100 is described as an example of a liquid ejecting apparatus. However, as for the liquid ejecting apparatus, there can be included a color filter manufacturing apparatus for a liquid crystal display equipped with a color material ejecting head as a liquid ejecting head, an electrode forming apparatus such as an organic EL display, an FED (field emission display), or the like equipped with an electrode material (conductive paste) ejecting head as a liquid ejecting head, a biochip manufacturing apparatus equipped with a bioorganic substance ejecting head as a liquid ejecting head and a precise pipette, and the like. Further, the medium to be recorded generally indicates the one to which a liquid ejected from the liquid ejecting head can be adhered. A circuit substrate, a circular optical recording medium, a preparation, and the like are included in the medium to be recorded.

The embodiments of the invention are described above. However, the technical scope of the invention is not limited to the scope described in the embodiments. It is apparent for a person skilled in the art to make various changes or modifications to the embodiments. Further, it is apparent from the description of the claims that such changed or modified embodiments can also be included in the technical scope of the invention.

What is claimed is:

1. A recording apparatus comprising:

a recording head which includes a nozzle plate having conductive property including an opening and for ejecting ink toward a medium to be recorded from the opening;

an absorbing member disposed so as to oppose the nozzle plate in the ejecting direction of the ink from the recording head and for absorbing the ink not adhered to the medium to be recorded, the absorbing member being formed by an insulating material;

an electrode disposed so as to make contact with the absorbing member; and an electric potential difference generator for generating an electric potential difference between the nozzle plate and the electrode and electrically attracting the ink not adhered to the medium to be recorded toward the electrode side; wherein, the electric potential difference generator varies the electric potential difference that is generated between the nozzle plate and the electrode so that the magnitude of the electric potential difference is varied in accordance with a distance between a portion of the absorbing member to which the ink is absorbed and the nozzle plate.

2. The recording apparatus according to claim 1, further comprising:

an electric field detector for detecting an electric field generated by the generated electric field difference between the nozzle plate and the electrode; and wherein the electric field detector outputs a signal in accordance with the magnitude of the electric field to the electric potential difference generator and the electric potential difference generator generates an electric potential difference having a magnitude varied in accordance with the signal output from the electric field detector between the nozzle plate and the electrode.

3. The recording apparatus according to claim 1 wherein, the electric potential difference generator includes a first electric potential difference generating section for generating an electric potential difference between the nozzle plate and the electrode when the ink is not absorbed by the absorbing member, a second electric potential difference generating section for generating an electric potential difference smaller than the electric potential difference generated by the first electric potential difference generating section between the nozzle plate and the electrode when the ink is absorbed by the absorbing member and the distance comes close, and a switching section for switching the first electric potential difference generating section and the second electric potential difference generating section by detecting the amount of the ink absorbed by the absorbing member.

4. The recording apparatus according to claim 3 wherein, the magnitude of the electric field generated by the electric potential difference is the same when the electric potential difference is generated by the first electric potential difference generating section between the nozzle plate and the electrode and when the electric potential difference is generated by the second electric potential difference generating section between the nozzle plate and the electrode.

5. The recording apparatus according to claim 3 further comprising:

a surface electrode disposed at the nozzle plate side of the absorbing member and made contact with the absorbing member; and a switching signal generator for outputting a signal which instructs to switch to the second electric potential difference generating section to the switching section when the surface electrode is made contact with a portion of the absorbing member in which the ink is absorbed.

6. The recording apparatus according to claim 1, wherein a distance between the nozzle plate and a supporting surface of the medium to be recorded can be changed, and the electric potential difference between the nozzle plate and the electrode is different in accordance with the distance between the nozzle plate and the supporting surface of the medium to be recorded.

* * * * *